United States Patent [19]

Fabbri et al.

[11] 4,188,875

[45] Feb. 19, 1980

[54] ALUMINUM CAN CRUSHING DEVICE

[76] Inventors: Charles Fabbri, 34632 Greenstone Common, Fremont, Calif. 94536; Lauren Dowiot, 1968 Swift Ct., Hayward, Calif. 94545; William Schleis, 34632 Greenstone Common, Fremont, Calif. 94536; Daniel Winterholler, 27530 Bahama Ave., Hayward, Calif. 94545; Debra Quintell, 623 Grove Wy., Hayward, Calif. 94541

[21] Appl. No.: 933,067

[22] Filed: Aug. 11, 1978

[51] Int. Cl.[2] ..... B30B 15/32

[52] U.S. Cl. ..... 100/218; 100/DIG. 2; 100/281; 100/295; 100/293

[58] Field of Search ..... 100/DIG. 2, 218, 281, 100/295, 245, 293

[56] References Cited

U.S. PATENT DOCUMENTS

| | | | |
|---|---|---|---|
| 2,603,271 | 7/1952 | Heymers | 100/DIG. 2 |
| 3,011,429 | 12/1961 | Kuslich | 100/DIG. 2 |
| 3,976,002 | 8/1976 | Gerlach | 100/DIG. 2 |

*Primary Examiner*—Billy J. Wilhite

[57] ABSTRACT

A manually operated press for crushing aluminum cans in the specific and exact manner of end to end while maintaining their original diameter, having a crushing chamber enclosed on its two sides by parallel walls of a frame, furthermore enclosed by a fixed stationary end, while the opposite end of crushing chamber is enclosed by a manually operated crushing member which is movable within sides of frame toward and away from fixed stationary end of crushing chamber with the bottom of crushing chamber enclosed by a base which crushing member guide slides upon, leaving top of crushing chamber open in which an aluminum can is placed horizontally in crushing chamber with the sides of the aluminum can parallel to the sides of the frame whereby the crushing member by means of mechanical advantage is advanced toward fixed stationary end of the crushing chamber thereby crushing the aluminum can by forcing one end toward its opposite end; while the walls of the crushing chamber, because of their close tolerance to the aluminum can sides, maintaining the aluminum cans original diameter as the aluminum can is being crushed.

1 Claim, 6 Drawing Figures

ALUMINUM CAN CRUSHING DEVICE

Figure 1:
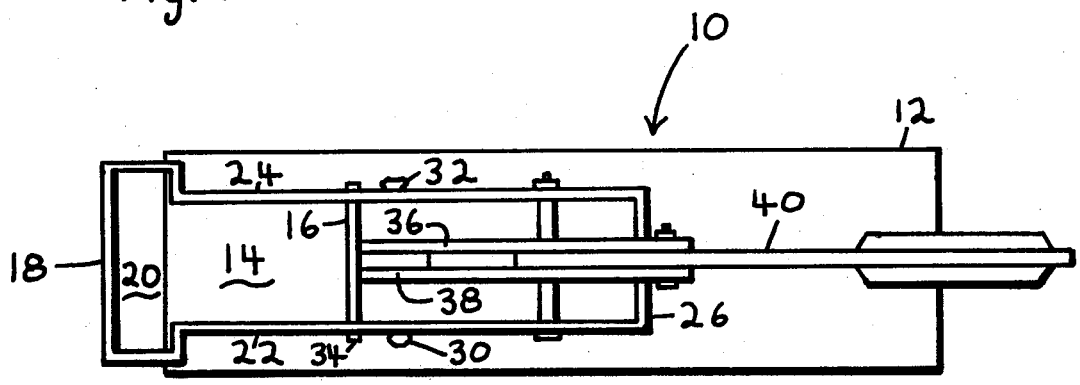
FIG. 1 is a top view of the invention.
Figure 2:
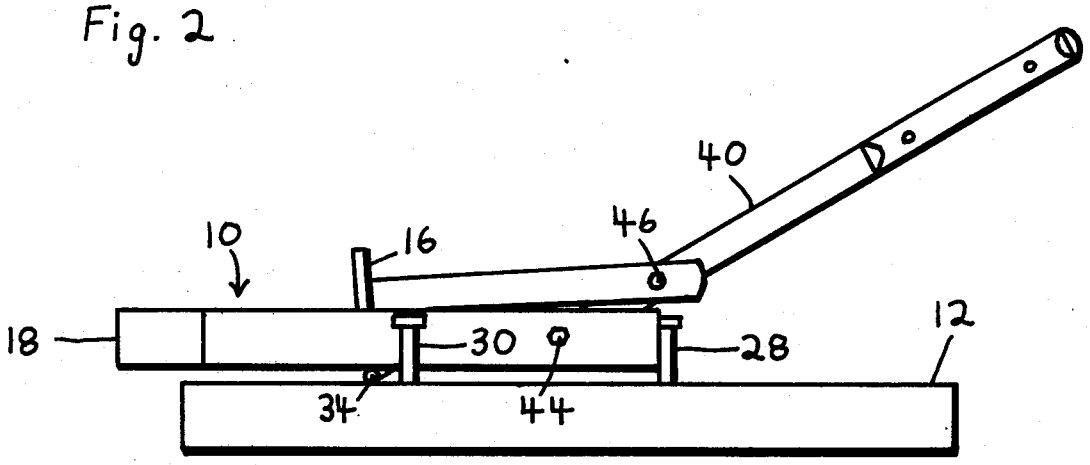
FIG. 2 is a sideview of the invention.
Figure 2A:
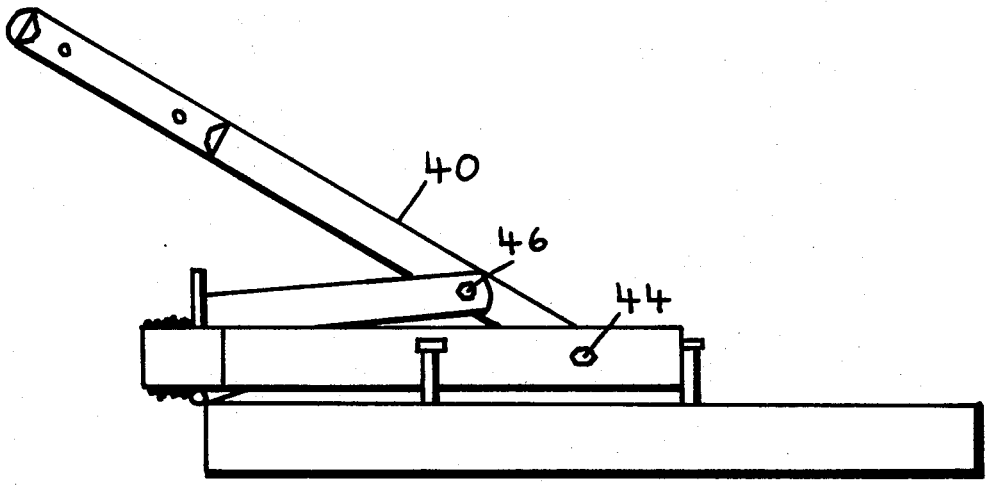
FIG. 2*a* is a sideview of the invention illustrating the crushing lever and crushing member in the crushing position including a crushed can.
Figure 4:
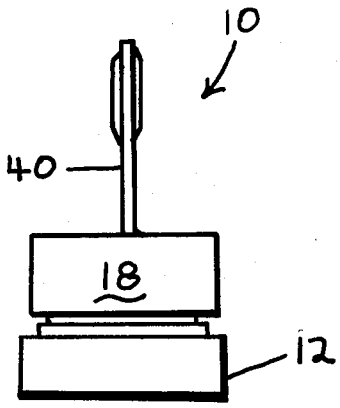
FIG. 4 is a front view of the invention.
Figure 5:
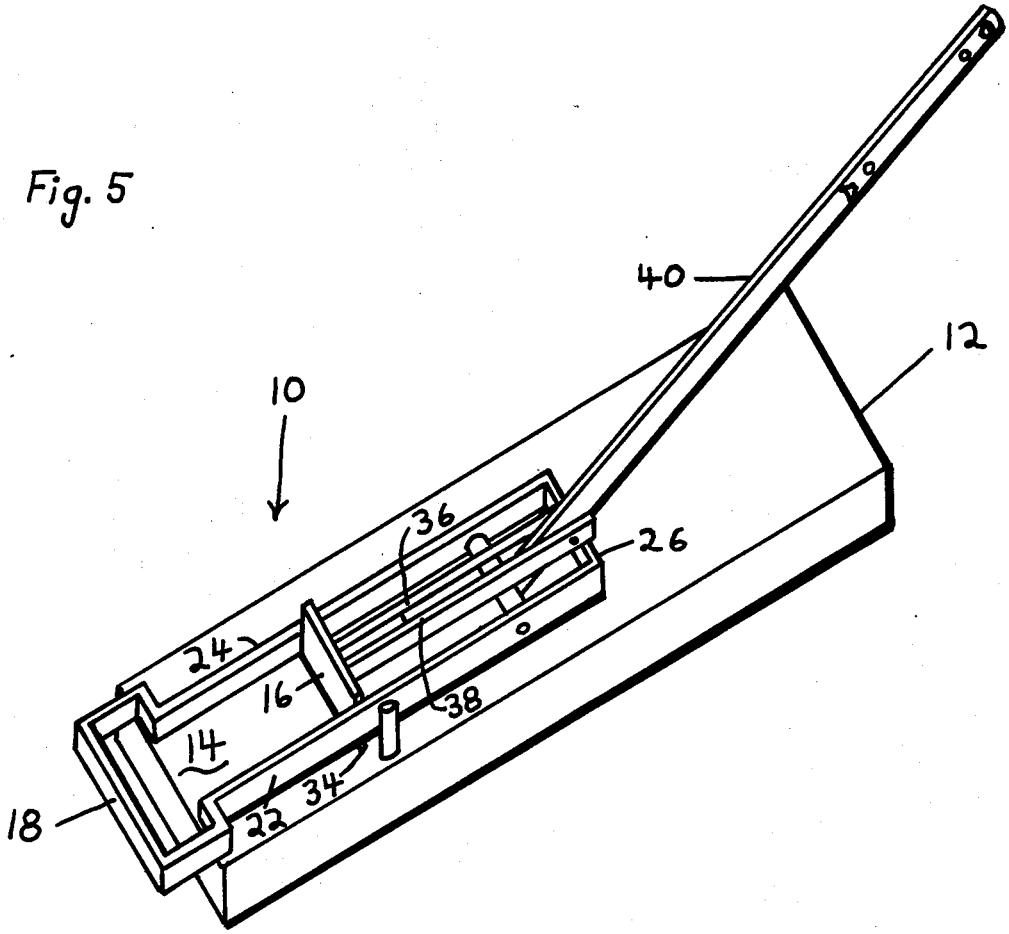
FIG. 5 is a view in perspective of the invention.

Referring now more in detail to the drawings in FIGS. 1, 2, 4, and 5 there is shown an aluminum can crushing device, generally designated as 10, having a base member 12. The base member 12 has an aluminum can supporting surface 14 shown in FIGS. 1 and 5 which extends between crushing member 16 shown in FIGS. 1, 2, 3, and 5 to approximately one and one half inches from the large end 18 shown in FIGS. 1, 2, 4, and 5. This open area between base member 12 and large end 18 is designated final crush area 20 shown in FIG. 1 eliminates the need to remove the crushed aluminum can by hand for when released it will descend away from the aluminum can crushing device 10. Extending upwardly and running parallel to each other are sidewalls 22 and 24 shown in FIGS. 1 and 5 which along with the crushing member 16 and large end 18 create an area of sufficient size to accept an uncrushed aluminum can of predetermined size. The crushing member 16 is located on top of base member 12 and slides on the aluminum can supporting surface 14 and between sidewalls 22 and 24 of the device 10. The fit between the crushing member 16 and the sidewalls 22 and 24 is such that there is little or no lateral movement of the crushing member 16. The sidewalls 22 and 24, respectively, form the left and right sides of the invention's frame with the large end 18 and the small end 26, shown in FIGS. 1 and 5, respectively, form the front and rear of the aluminum can crushing device 10. These four sides, the sidewalls 22 and 24, small end 26 and large end 18 construct the invention's frame which is mounted to the base member 12 by three frame mounts 28 and 30 shown in FIG. 2 and 32 shown in FIG. 1. The frame mounts 28, 30, and 32 are secured to the frame by welding or other suitable methods and extend past the bottom of the frame. The frame mounts 28, 30, and 32 are secured to the base member 12 by bolts or other suitable fasteners or methods such as welding. The frame mounts 28, 30, and 32 thereby hold the inventions frame above the base member 12 surface which is illustrated in FIG. 2. This forms an area in which the crushing member guide 34 shown in FIGS. 1, 2, 3, and 5 may only slide toward and away from the large end 18. The crushing member guide 34 is fastened to the bottom of the crushing member 16 by a suitable method such as welding and prevents the crushing member from rising up and away from the aluminum can supporting surface 14 during the crushing stroke of the invention. The crushing member 16 is fastened to two crushing member rods 36 and 38 as shown in FIGS. 1 and 5 by welding or other suitable methods. A crushing lever 40 as shown in FIGS. 1, 2, 2*a*, and 5 is pivotly secured at the small end 26 by means of a bolt 44 as illustrated in FIGS. 2 and 2*a* or other suitable fastener. The crushing member rods 36 and 38 are also pivotly secured to the crushing lever 40 by means of a bolt 46 as shown in FIGS. 2 and 2*a* or other suitable fastener approximately three inches away from where crushing lever 40 is pivotly secured to the small end 26.

Figure 3:
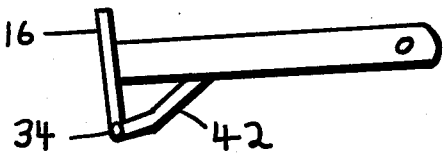
FIG. 3 is a sideview of a crushing member and attached parts forming part of the present invention.

The combination of this construction gives the invention sufficient mechanical advantage to crush an aluminum can with a minimum amount of effort. A drop stop 42 shown in FIG. 3 is secured at one end to the crushing member guide 34 while its opposite end is secured to crushing member rods 36 and 38 by a suitable means such as welding. The drop stop 42 prevents the crushing member 16 and crushing member guide 34 from falling into final crush area 20 during the final movement of the crushing stroke of the aluminum can crushing device 10. With the crush lever 40 in a non-crushing position as illustrated in FIGS. 1, 2, and 5 an aluminum can of predetermined size is placed horizontally on the aluminum can supporting surface 14, between sidewalls 22 and 24 and in front of the crushing member 16. The crush lever 40 may now be moved by hand in the direction of the large end 18. The crush lever 40 in turn forces the crushing member 16 by means of the crushing member rods 36 and 38 against one end of the aluminum can forcing its opposite end against the large end 18. By moving the crush lever 40 completely through its arc of approximately 140 degrees will result in the aluminum can being crushed to approximately three quarters of an inch in thickness while maintaining its original diameter for throughout the major portion of the crushing procedure the aluminum cans diameter is maintained by the sidewalls 22 and 24. As the crush lever 40 is moved in the opposite direction away from the large end 18 the now crushed aluminum can is released and will descend from final crush area 20 and leaves the aluminum can supporting surface vacant to accept another aluminum can of predetermined size to be crushed.

What I claim as new and desire to protect by Letters Patent of the United States is:

1. A manually operated press for crushing aluminum cans comprising a base member, three mounting elements on said base member, a rectangular frame fastened to said elements and being held in a spaced position above said base member, one end of said frame having an enlarged area which extends past one edge of said base member, a reciprocal crushing member mounted within said frame, a guide fastened to the bottom of said crushing member and extending in the space between said base member and said frame so as to guide the crushing member during its movement, the crushing member being confined within said frame during its movement, two rods attached to one side of said crushing member, a lever pivotally attached to said rods and said frame so as to provide manual means to reciprocate the crushing member, a drop stop element attached between said crushing member and said rods so as to prevent said crushing member from dropping when it reaches said enlarged area of said frame, whereby a can to be crushed is laid on said base member between said crushing member and said enlarged area of said frame, said crushing member crushing the can in said enlarged area and the crushed can being allowed to fall by gravity when said crushing member is reciprocated back from said enlarged area.

* * * * *